US006659230B1

(12) United States Patent
Jenkins

(10) Patent No.: US 6,659,230 B1
(45) Date of Patent: Dec. 9, 2003

(54) SAFETY BRAKE FOR STAIRLIFTS

(75) Inventor: Martyn Harry Jenkins, Salisbury (GB)

(73) Assignee: Stannah Stairlifts Limited, Hampshire (GB)

( * ) Notice: Subject to any disclaimer, the term of this patent is extended or adjusted under 35 U.S.C. 154(b) by 0 days.

(21) Appl. No.: 09/889,028

(22) PCT Filed: Jan. 17, 2000

(86) PCT No.: PCT/GB00/00100

§ 371 (c)(1),
(2), (4) Date: Aug. 3, 2001

(87) PCT Pub. No.: WO00/44663

PCT Pub. Date: Aug. 3, 2000

(51) Int. Cl.[7] ..... B66B 5/04; B66B 9/08
(52) U.S. Cl. ..... 187/202; 187/373; 188/180
(58) Field of Search ..... 187/200–202, 187/305, 368, 373; 188/180; 104/118

(56) References Cited

U.S. PATENT DOCUMENTS

| | | | | | |
|---|---|---|---|---|---|
| 2,888,099 | A | * | 5/1959 | Hoffman | 187/202 |
| 3,580,376 | A | * | 5/1971 | Loshbough | 198/323 |
| 3,662,859 | A | * | 5/1972 | Flinchbaugh | 187/202 |
| 4,046,226 | A | | 9/1977 | Flinchbaugh | |
| 4,179,012 | A | * | 12/1979 | Heberle | 187/201 |
| 4,856,623 | A | | 8/1989 | Romig, Jr. | |
| 5,052,521 | A | * | 10/1991 | Wendt et al. | 187/202 |

FOREIGN PATENT DOCUMENTS

| | | | | | |
|---|---|---|---|---|---|
| CH | 481007 | | | 11/1969 | |
| DE | 805782 | | | 5/1951 | |
| EP | 244030 | A1 | * | 11/1987 | B66B/5/02 |
| EP | 442429 | A2 | * | 8/1991 | B66B/9/08 |
| FR | 2478051 | | | 9/1981 | |
| GB | 2231028 | A1 | * | 11/1990 | B66B/9/08 |
| GB | 2264283 | A | | 8/1993 | |
| JP | 06171864 | A | * | 6/1994 | B66B/9/08 |

* cited by examiner

*Primary Examiner*—Kathy Matecki
*Assistant Examiner*—Thuy V. Tran
(74) *Attorney, Agent, or Firm*—Edwin D. Schindler

(57) ABSTRACT

The present invention relates to an overspeed governor for a stairlift and is characterised in that it can operate in two opposite directions. This means that the same device can be fitted to stairlifts regardless of whether the stairlift installation is left or right handed.

11 Claims, 1 Drawing Sheet

SAFETY BRAKE FOR STAIRLIFTS

FIELD OF THE INVENTION

This invention relates to stair mounted elevators or lifts, commonly known as stairlifts. In particular, the invention relates to a governor or speed-limiting device to control or brake movement of a stairlift carriage in the event that some failure or malfunction in the drive mechanism, driving the carriage along a stairlift rail, allows the carriage to exceed a predetermined maximum speed.

BACKGROUND

Stairlifts, in the form of a carriage mounted for movement along a rail, are well known for moving aged or handicapped persons up and down staircases. Typically stairlifts incorporate a drive motor in the carriage, the output of which engages a rack, extending along the rail, via a gearbox. However, if there is a failure of or in the motor, gearbox or rack, the carriage may be left to travel down the sloping rail in an uncontrolled manner.

There is a requirement, at least in the United Kingdom, that stairlifts incorporate an overspeed governor to automatically apply a braking force in the event that component failure or malfunction allows the carriage to exceed a predetermined speed whilst moving down the rail. In the past these devices have tended to be quite complex in form and have only been able to apply a braking force when the carriage is moving in one direction. Thus, depending on which side of the stairway the stairlift apparatus is mounted, a different governor must be used.

It is an object of this invention to provide a governor for a stairlift which addresses the aforementioned problems or which at least provides a useful choice.

SUMMARY OF THE INVENTION

Broadly, the present invention concerns a governor apparatus for governing the velocity of a stairlift carriage along a stairlift rail with the stairlift carriage being movable in opposite directions along the longitudinal axis of the stairlift rail. The governor apparatus includes a braking member displaceable into contact with the stairlift rail and operating means being operable, when the speed of the stairlift carriage along the stairlift rail exceeds a predetermined maximum speed, for causing the braking member to engage the stairlift rail. The operating means comprises a guiding surface, rotatable with the movement of the carriage along the stairlift rail, and a follower, which is operatively connected to the braking member, in a sliding contact with the guiding surface for when the speed of the stairlift carriage is less than the predetermined maximum speed.

Said operating means is preferably constructed and arranged to trigger under the influence of a force induced centrifugally. To this end, said operating means preferably includes guide means rotatable with the movement of said carriage along said rail, and a roller in sliding contact with said guide means, said roller being connected to said braking member.

Said roller is preferably mounted for rotation on a first end of an operating lever, the other end of said operating lever being pivotally mounted to said braking member.

Preferably said braking member is mounted for rotation about the same axis of rotation as said guide means, said braking member having cam surfaces which are non-concentric with respect to said axis of rotation.

Preferably said guide means includes an inner guide surface and an outer guide surface, said roller contacting said inner guide surface when the speed of said carriage is below said predetermined maximum, and contacting said outer guide surface when said speed exceeds said predetermined maximum, said outer guide surface being constructed and arranged to allow the position of said roller to be locked with respect to said guide means.

Preferably said outer guide surface includes at least one locking notch sized to receive said roller.

Preferably said braking member has a central, inoperative position in which said braking member is symmetrical about an axis passing through the axis of rotation thereof.

Preferably said governor further includes a catch to retain said braking member, against rotation, in said central position when not under the influence of said operating means.

In a second aspect the invention provides a stairlift carriage including the governor as set forth above.

Many variations in the way the present invention may be performed will present themselves to those skilled in the art. The description which follows is intended as an illustration only and the absence of description of particular alternatives or variants should in no way be applied to limit the scope of the invention. Such description of specific elements which follows should also be interpreted as including equivalents whether existing now or in the future. The scope of the invention should be defined solely by the appended claims.

BRIEF DESCRIPTION OF THE DRAWINGS

One form of governor incorporating the various aspects of the invention will now be described with reference to the accompanying drawings in which.

DESCRIPTION OF WORKING EMBODIMENTS

Figure 3:
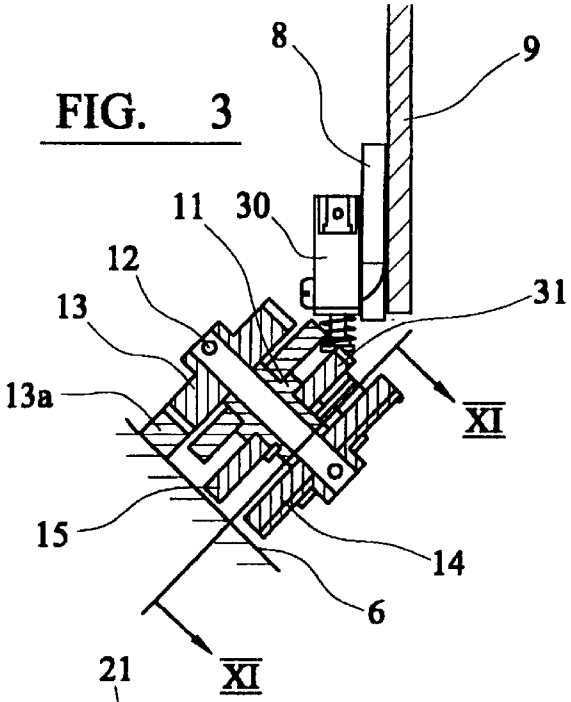
FIG. 3: Shows a sectional view through the governor shown in FIG. 1.

Referring to the drawings, the present invention provides a governor 5 for a stairlift carriage (not shown), the carriage being moveable, in the conventional manner, along a rail, a surface of which is indicated by reference numeral 6 in the drawings. As will be apparent from FIG. 3 the rail surface 6, in this embodiment, is aligned at 45° to the horizontal.

In the form shown, the governor 5 includes a mounting bracket 7 which forms the basis of the governor. The bracket 7 comprises an angled upper mounting section 8 so configured that when section 8 is mounted on a vertical side plate 9 of the carriage, the locking members of the governor (described in detail below) are arranged to engage rail surface 6 aligned at 45° to the horizontal. The mounting section 8 extends down into a lower section 10.

Mounted on, and extending through, the lower section 10 is a bearing journal 11 in which shaft 12 is rotatably mounted.

Mounted at one end of the shaft 12 is a drive gear 13. The drive gear 13 is configured and mounted so as to engage a drive rack 13*a* extending along the rail surface 6, the drive rack forming part of the main drive system serving to power the stairlift carriage along the rail. Mounted at the opposite end of shaft 12, so as to rotate with drive gear 13, is a flywheel 14 forming part of an operating means which will be described in greater detail below.

The governor further includes a braking member 15 which is rotatable on the outer surface of the journal 11, is thus independent of the drive gear 13, and is displaced about journal 11 by a link arm 16. Link arm 16 is pivotally mounted, at one end thereof, on the braking member 15 and includes, at its other end, a roller 17. The roller 17 engages in guide track 18 [FIG. 4] provided on the inner surface of flywheel 14, thereby connecting the flywheel 14 to the braking member 15. As will be described in greater detail below, the connection is a sliding connection for so long as the speed of the carriage is below the predetermined maximum speed, but becomes a fixed connection in the event the speed of the carriage exceeds the predetermined maximum.

It will be appreciated that arrangement of the arm 16 and roller 17 is such that the roller normally rests, under gravity, on the inner guide surface defined by the inner central part 19 of the flywheel. The system is so configured that, at acceptable operating speeds, gravity is sufficient to maintain the roller in contact with inner central part 19. However, should the speed of the carriage [and thus the rotational speed of shaft 12] exceed an acceptable level, the roller moves outwards under centrifugal action to engage outer guide surface 20.

Figure 4:
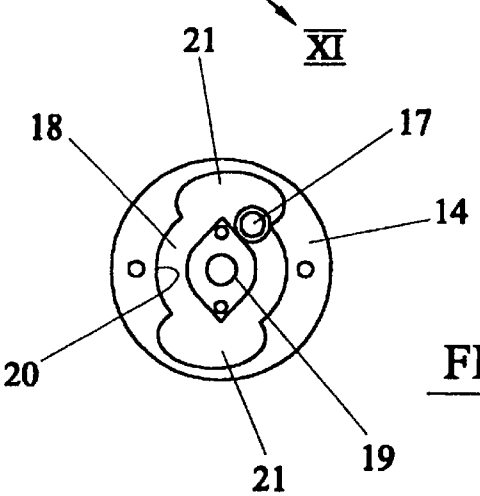
FIG. 4: Shows a view along the line IV—IV in FIG. 3.

As can be seen from FIG. 4, outer guide surface 20 is adapted to lock the position of roller 17 and, to that end, preferably includes at least one, and more preferably two, braking notches 21. It will be appreciated that, when the roller 17 enters one of the notches 21 further rolling action over the outer guide surface is prevented and the position of the roller is effectively locked with respect to the guide. In this event, the rotation of the flywheel 14 is transferred to the braking member 15 through link arm 16.

Figure 2:
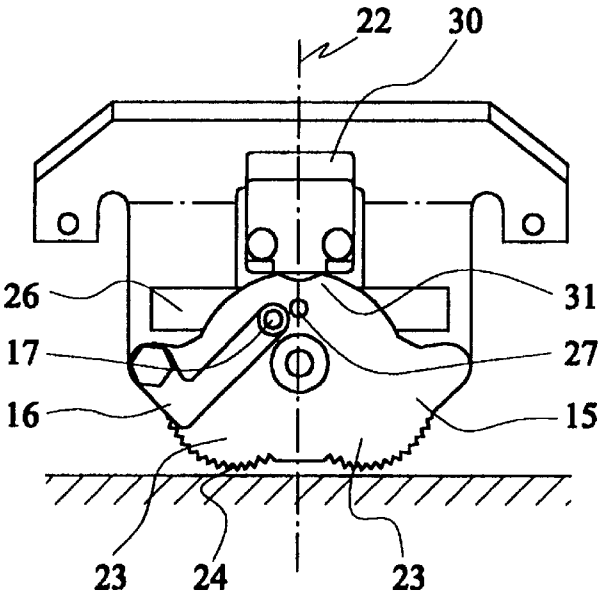
FIG. 2: Shows a similar view to that shown in FIG. 1 but with certain detail omitted.

As can be seen most clearly in FIG. 2, the braking member 15 has a central inoperative position in which the member 15 is substantially symmetrical about a vertical line 22 passing through the pivot axis on which the braking member is mounted. To either side of line 22 the braking member includes cam surfaces 23 arranged to engage the rail surface as the braking member is pivoted about its mounting axis. The cam surfaces may be provided with teeth 24 or the like to enhance frictional engagement with the rail as the braking member is pivoted into engagement with the rail 6.

Figure 1:
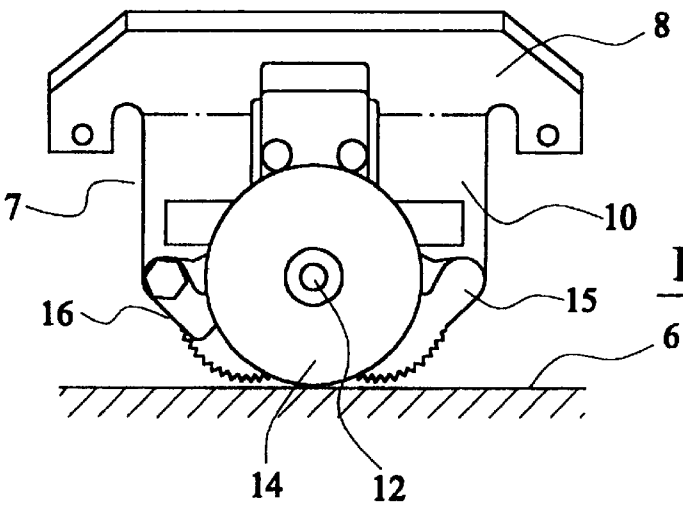
FIG. 1: Shows an elevational view of a governor according to the invention.

To prevent the braking member inadvertently moving into engagement with the rail 6, catch means is preferably provided to maintain the being member in the central position as shown in FIGS. 1 and 2, when not under the influence of the flywheel 14. However, the catch means is such that the same is overridden by flywheel effect when the roller 17 engages in one of locking notches 21.

In the form shown the catch means comprises a simple leaf spring 26 mounted on bracket 7 and having a central indent (not shown) to receive one end of locking pin 27 extending from the rear face of braking member 15. When roller 17 engages in one of notches 21, the pin 27 is forced out of the indent in the leaf spring 26.

Finally, in the form of governor depicted and described herein, electrical switch 30 is provided, the switch 30 being mounted so as to be activated by upper lobes 31 on the braking member 15, when the barking member 15 is pivoted into an operative position, to cut power to the carriage drive motor [not shown].

Since the braking member and the inner guide surface are symmetrical, the governor as described herein, will work equally effectively in both directions. This means that the same governor can be used regardless of whether the carriage is to be left or right-handed. This in turn reduces expense and the likelihood of installation-related problems.

It will thus be appreciated that the present invention, at least in relation to the working embodiment described herein, provides a relatively simple form of over-speed governor for a stairlift capable of effective operation regardless of the orientation of the stairlift installation.

What is claimed is:

1. A governor apparatus for governing speed of movement of a stairlift carriage along a stairlift rail, the stairlift carriage being movable in opposite directions along a longitudinal axis of the stairlift rail, said governor apparatus comprising:

a braking member displaceable into contact with the stairlift rail; and, operating means operable for causing engagement of said braking member with the stairlift rail when the speed of movement of the stairlift carriage along the stairlift rail exceeds a predetermined maximum speed, said operating means comprising:

a guiding surface, rotatable with movement of the stairlift carriage along the stairlift rail; and, a follower, operatively connected to said braking member, in sliding contact with said guiding surface when the speed of movement of the stairlift carriage is less than said predetermined maximum speed.

2. The governor apparatus according to claim 1, wherein said operating means includes means for inducing said follower to leave said guiding surface under an influence of a force induced centrifugally.

3. The governor apparatus according to claim 1, wherein said follower includes a roller mounted for rotation on a first end of an operating lever with a second end of said operating lever being pivotally mounted to said braking member.

4. The governor apparatus according to claim 1, wherein said braking member is mounted for rotation about an axis of rotation which is the same as an axis for rotation for said guiding surface, said braking member having non-concentric cam surface relative to said axis of rotation of said braking member.

5. The governor apparatus according to claim 1, further comprising an outer guide surface and with said guiding surface including an inner guide surface, said follower contacting said inner guide surface when the speed of movement of the stairlift carriage is below said predetermined maximum speed and said follower contacting said outer guide surface when the speed of movement of the stairlift carriage exceeds said predetermined maximum speed, said outer guide surface being constructed for allowing and positioning of said follower to be locked relative to said guiding surface.

6. The governor apparatus according to claim 5, wherein said outer guide surface includes at least one locking notch for receiving said follower.

7. The governor apparatus according to claim 5, wherein said operating means further includes a flywheel with said guiding surface and said outer guide surface being formed in said flywheel.

8. The governor apparatus according to claim 1, wherein said braking member is rotatably displaceable about a first axis into contact with the stairlift rail, said braking member including a central inoperative position wherein said braking member is symmetrical about a second axis extending perpendicularly to said first axis.

9. The governor apparatus according to claim 8, further comprising a catch for retaining said braking member, against rotation, in said central inoperative position when not being influenced by said operating means.

10. A stairlift apparatus, comprising:

a stairlift rail;

a stairlift carriage movable in opposite directions along a longitudinal axis of said stairlift rail; and, a governor apparatus for governing a speed of movement of said stairlift carriage along said stairlift rail, said governor apparatus comprising:

a braking member displaceable into contact with said stairlift rail; and, operating means operable for causing engagement of said braking member with said stairlift rail when the speed of movement of said stairlift carriage along said stairlift rail exceeds a predetermined maximum speed, said operating means comprising:

a guiding surface, rotatable with movement of said stairlift carriage along said stairlift rail; and, a follower, operatively connected to said braking member, in sliding contact with said guiding surface when the speed of movement of said stairlift carriage is less than said predetermined maximum speed.

11. The stairlift apparatus according to claim 10, wherein said governor apparatus further comprising an outer guide surface and said guiding surface including an inner guide surface, said follower contacting said inner guide surface when the speed of movement of the stairlift carriage is below said predetermined maximum speed and said follower contacting said outer guide surface when the speed of movement of said stairlift carriage exceeds said predetermined maximum speed, said outer guide surface being constructed for allowing and positioning of said follower to be locked relative to said guiding surface.

* * * * *